US006446531B1

(12) United States Patent
Colombani

(10) Patent No.: US 6,446,531 B1
(45) Date of Patent: Sep. 10, 2002

(54) SPRINKLER RISER EXTRACTION INSERTION TOOL

(76) Inventor: Louie V. Colombani, 1741 Reed Ave., W. Sacramento, CA (US) 95605

( * ) Notice: Subject to any disclaimer, the term of this patent is extended or adjusted under 35 U.S.C. 154(b) by 0 days.

(21) Appl. No.: 09/531,276

(22) Filed: Mar. 20, 2000

(51) Int. Cl.[7] ..... B25B 23/08

(52) U.S. Cl. ..... 81/441; 81/459; 81/177.8; 81/125.1

(58) Field of Search ..... 81/441, 459, 177.7, 81/177.8, 177.9, 125.1, 177.1, 427.5, 53.2, 488

(56) References Cited

U.S. PATENT DOCUMENTS 5,184,531 A * 2/1993 Wickson et al.
6,349,624 B1 * 2/2002 Fahringer

* cited by examiner

*Primary Examiner*—Joseph J. Hail, III
*Assistant Examiner*—Willie Berry, Jr.
(74) *Attorney, Agent, or Firm*—Mark C. Jacobs

(57) ABSTRACT

An apparatus is disclosed for removing, re-inserting or inserting for the first time, sprinkler system risers into sprinkler system piping connector which connectors are located underground. The apparatus features an elongated tubular member having a pair of opposed slots from which wings or blades are urged upon impact of a threaded shaft disposed in the tubular member. The threaded shaft is moved downwardly to impact the blades by rotation of a handle attached to a threaded shaft. This downward movement of the shaft is carried out after the apparatus is inserted into a riser such that the wings can press upon the interior wall of the riser whereby continued threading rotation of the shaft translates the rotary motion to the riser such that the riser which has male threads, can threadedly engage a female threaded piping connector.

8 Claims, 4 Drawing Sheets

SPRINKLER RISER EXTRACTION INSERTION TOOL

FIELD OF THE INVENTION

This application pertains to home and business sprinkler system maintenance and, more particularly, to the tool to insert replacement sprinkler risers into underground connectors.

BACKGROUND OF THE INVENTION

In California, Texas, Arizona and many other states, homeowners rely on underground sprinkler systems for the irrigation of their lawns and flowerbeds. Such systems utilize a series of interconnected polyvinyl chloride pipes, which are joined by various connectors having plastic risers generally threadedly engaged to tee connectors. In addition, at the end of a pipe run, an elbow having a threaded female connection for the receipt of a riser may also be employed. Such systems are well known in the art and are deemed to be conventional today. Be Sprinkler systems may be controlled either electronically, or manually with respect to the flow of water through the pipes at a particular point in time during the course of a day or week. The nature of the control of the system has no bearing on the invention at hand.

The connector members, such as tees and elbows are generally buried anywhere from 3 to 6 inches below ground level. The riser then is threadedly engaged to the tee or elbow and a sprinkler head is attached to the riser. On many an occasion, a riser can break off, due to it being hit by a lawnmower, a bicycle wheel, or an adult walking or a child playing. Risers are generally made of either rigid or soft plastic such as polyvinyl chloride. They cost in the range of 0.29 cents to $1.00 for units that vary in length from 2 inches to about 8 to 10 inches. Risers of greater length are also found in the marketplace.

Oftentimes, especially when the earth is hard and packed, mere rotation of the sprinkler riser in a counter-clock direction will enable the homeowner or caretaker to remove the old riser that may have become broken off . Indeed tools are available in the marketplace to achieve this counter rotation capability.

A benefit in the process of removing broken risers that can be gained from this too is that often no digging is required to remove the broken riser.

Problems are often incurred in applying the new riser into a connector that is below ground level without the use of this tool.

It is a primary object of this invention to provide a unique tool to simplify both the extraction and replacement of broken sprinkler risers.

It is a secondary object to provide a tool that permits these tasks to be carried out, often with little or no digging.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

An apparatus is disclosed for extracting broken risers and for re-inserting or inserting for the first time, sprinkler system risers into sprinkler system piping connectors which connectors are located underground often without removing soil that is above or around an existing riser being replaced. The apparatus features an elongated tubular member having a pair of opposed slots from which wings or blades are urged upon impact of a threaded shaft disposed in the tubular member. The threaded shaft is moved downwardly to impact the blades by rotation of a handle attached to a threaded shaft. This downward movement of the shaft is carried out after the apparatus is inserted into a riser such that the wings can press upon the interior wall of the riser whereby continued threading rotation of the shaft translates the rotary motion to the riser such that the riser which has male threads, can 17 threadedly engage a female threaded piping connector.

DESCRIPTION OF THE PREFERRED EMBODIMENT

Figure 1:
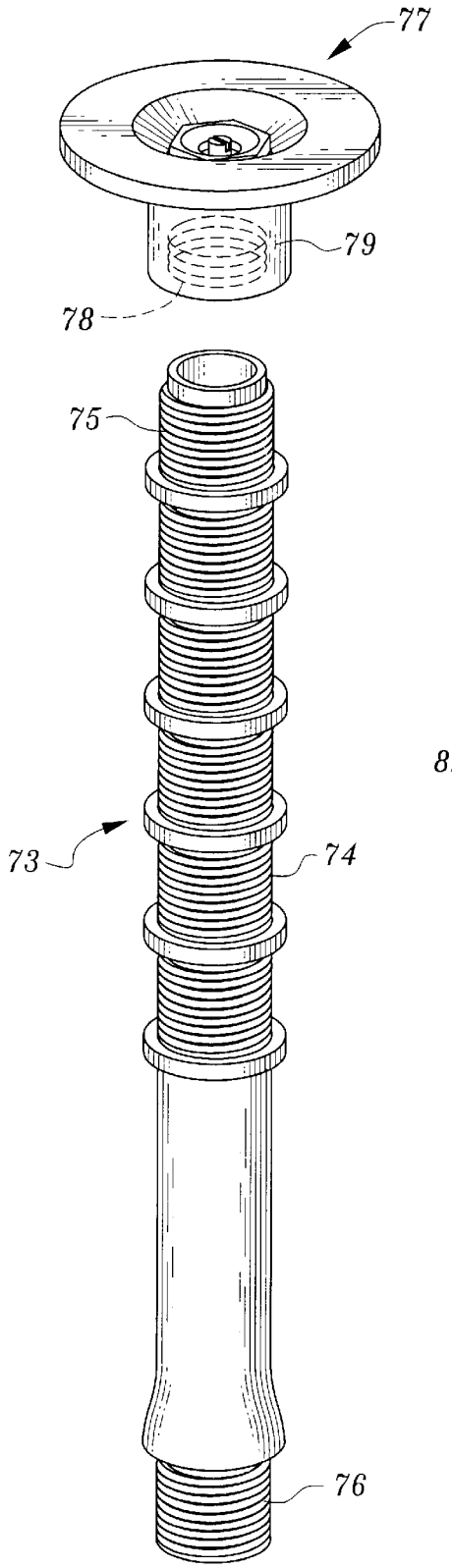
Fig. 1 (Prior Art)
FIG. 1 is a perspective view of a sprinkler head and riser disconnected from each other.

In FIG. 1 there is shown a conventional riser 73 made usually of plastic which has an elongated tubular body 74 with male threads 75 at one end here the upper end, and male threads 76 at the lower end as well. Also seen in this first figure is a typical home sprinkler system nozzle 77 having a body portion 79 which is internally female threaded 78. Threads 79 are intended to threadedly receive threads 75 of the riser.

Figure 2:
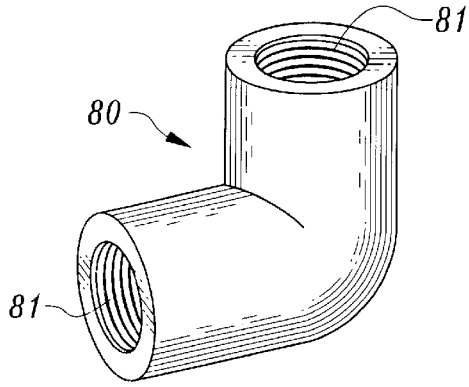
Fig. 2 (Prior Art)
FIG. 2 is a prior art PVC elbow pipe connector.
Figure 3:
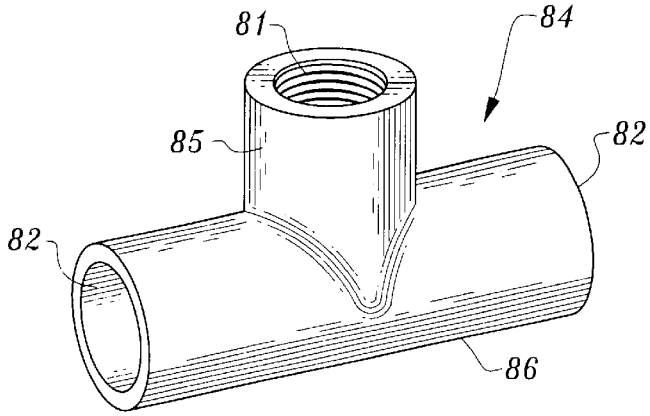
Fig. 3 (Prior Art)
FIG. 3 is a prior art PVC tee connector.

In FIGS. 2 and 3 commonly available prior art piping connectors used in home and commercial sprinkler systems are seen. These units are available in ½-inch,¾-inch and 1-inch diameter sizes and larger. FIG. 2 depicts an elbow 80 having female threads 81 at both ends. In FIG. 3, a tee 84 having female threads 81 at the terminus of the upstanding portion, 85 and "slip fit" also known as non-threaded, termini 82 on the horizontal portion 86.

Figure 4:
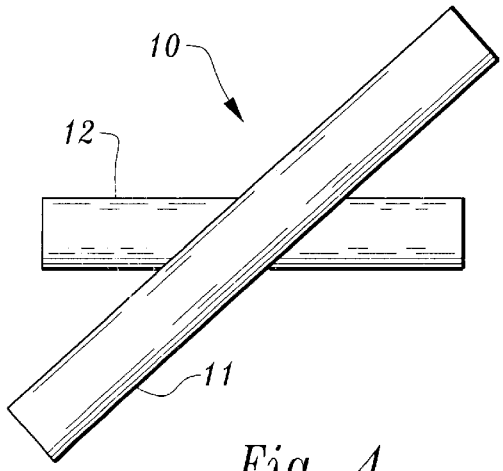
FIG. 4 is a top plan view of the apparatus of this invention.
Figure 5:
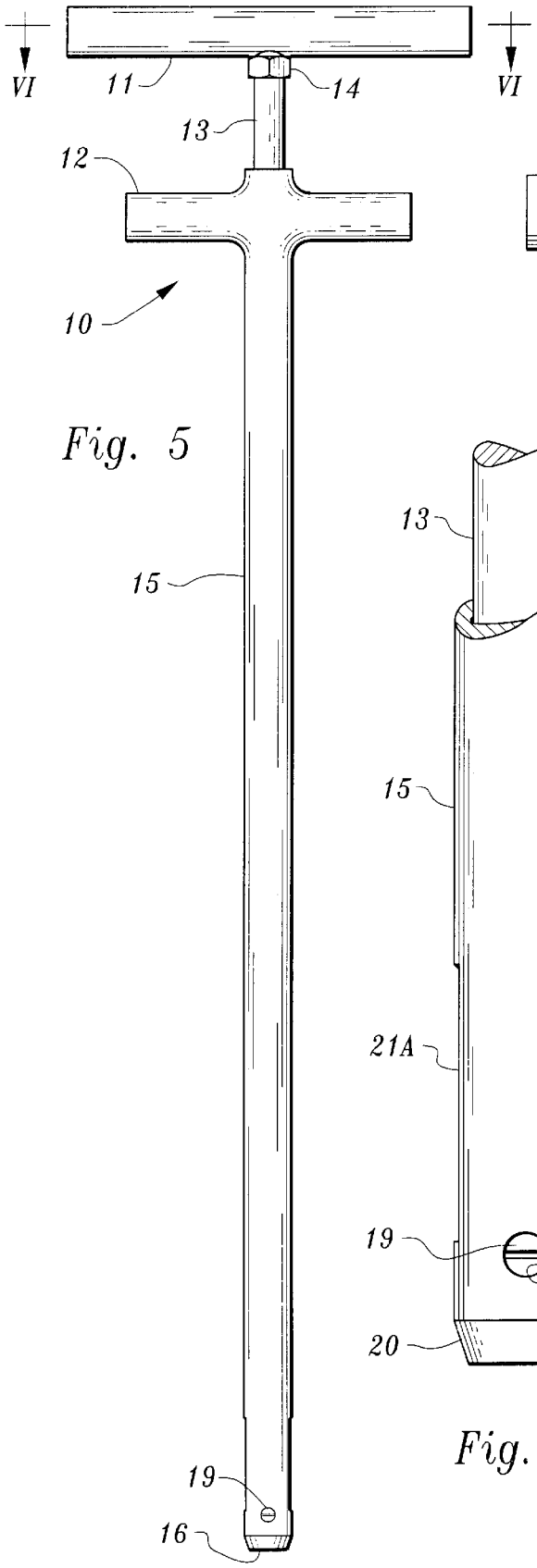
FIG. 5 is a side elevational view thereof.

In FIG. 4, a top plan view of the apparatus and in FIG. 5, an elevational view of this invention is seen. The apparatus 10 has a handle 11 disposed at the top of a threaded shaft 13. A spacer nut 14, may be threadedly disposed upon the threaded shaft 13, just beneath the handle 11.

A fixedly mounted tee handle 12 is disposed normal to an internally threaded tube 15. This tee handle 12 is also seen in the top plan view FIG. 4. Since the handle is rotatable from the position shown in FIG. 5, the relative positioning of the two members in FIG. 4 is readily understood.

Figure 10:
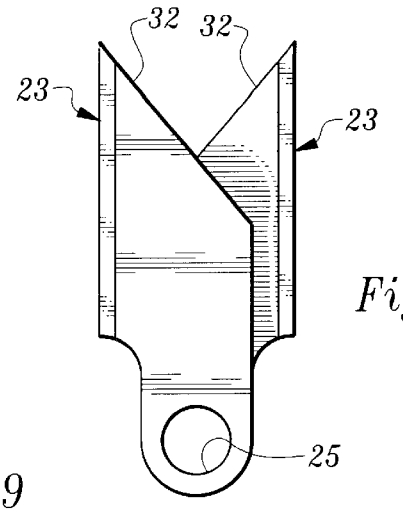
FIG. 10 is a top plan view of the two blades utilized in this invention in their superposed position for mounting of the apparatus.

Tubular member 15 is internally threaded the entire length of the tube. Adjacent the distal end thereof is a set screw 19 which is utilized to retain the blades or wings as they may also be referred to and which wings are seen in FIG. 10. Tube 15 is open at the lower (distal) end 16. Tip 20 is seen to taper inwardly slightly to ensure proper engagement of the apparatus 10 with a riser to be placed into position in a piping connector and to ensure proper depth into the elbow or tee such that the blades will be able to carry out an easy extraction.

Figure 6:
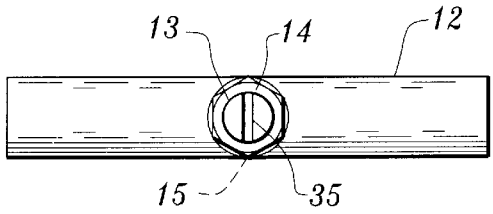
FIG. 6 is a view taken along line VI—VI of FIG. 5.
Figure 7:
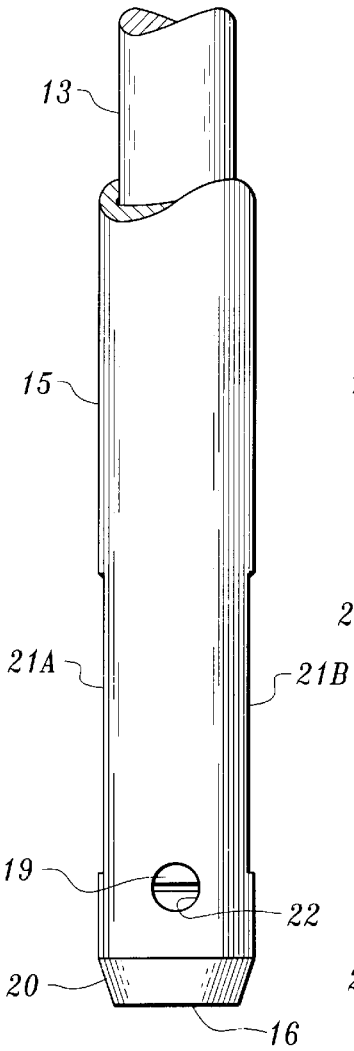
FIG. 7 is a close-up front elevational view of the bottom of this apparatus.

FIG. 6, is a view taken along the line VI—VI of FIG. 5. Thus the handle 11 has been removed, but the nut 35 is seen to be in its usual position, retained upon shaft 13 which shaft extends upwardly through the tee handle 12, as per FIG. 5. Slot 35 is a slotted screwdriver slot, while useful for emergency removal of the shaft 13 should the shaft 13 be threaded to far downwardly within tube 15 to permit finger grasping for upward withdrawal it's primary use is during the assembly of the unit. Turning now to FIG. 7, which is a close-up view of the distal end of the apparatus 10, the tapered tip 20 of the open end 16 is readily seen. Set screw 19 which retains the blades 23 in a manner to be described, is also seen. Set screw is received by a threaded bore in tube 15; namely, 22.

Figure 8:
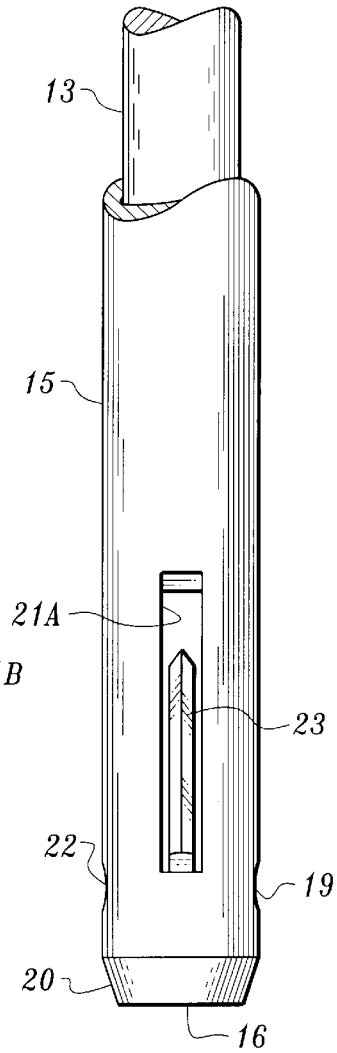
FIG. 8 is a close-up elevational view of one side of this apparatus. The other side is a mirror image thereof.

In FIG. 8, there is depicted a view similar to FIG. 7, but oriented 90 degrees. Thus adjacent the tapered end 20, one notes the set screw 19 for retaining the opposed blades, one of which 23 is seen. The set screw passes through the blades and exits the tube 15 at the self-taping bore 22. The slot in which the blade 23 resides is designated 21A, while the slot on the opposite side of the tubing 15 is designated 21B. These two slots are equal size and are aligned and have tapers on their upper end to keep the blades from entering into the tubular member 15.

Figure 9:
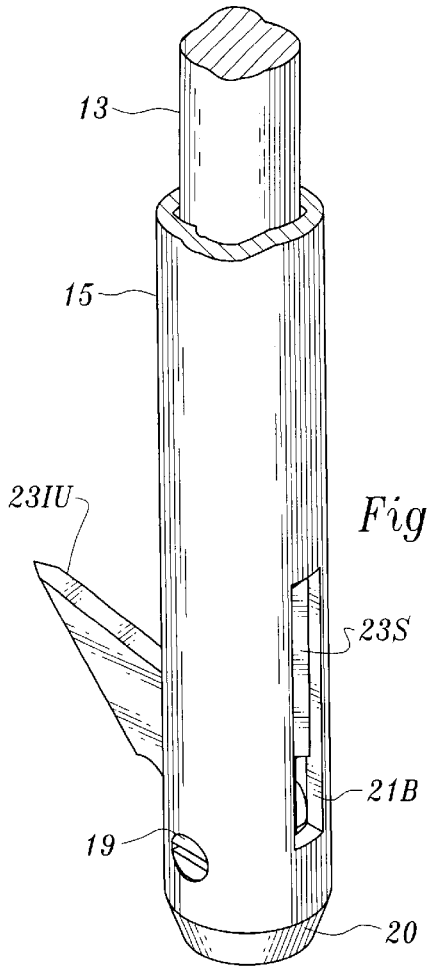
FIG. 9 is a perspective view close-up of the bottom of this apparatus with one blade outwardly disposed and one blade retained inwardly.

FIG. 9 is a rotated view similar to FIG. 8. Here the apparatus has been disassembled, such that only one blade of the pair is present. In point of fact such would never be the case, as the two blades are used in tandem and are moved in tandem. By such artificial positioning, the movement from a first stowed position to a second in-use position can be readily illustrated. Thus the stowed blade is designated 23-S, while the one set for the in-use position is designated 23-IU.

Figure 11:
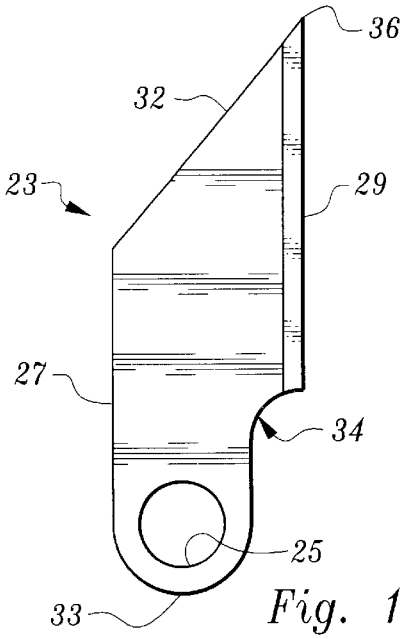
FIG. 11 is a plan view of one of the blades.

FIG. 10 is a plan view of the two aligned blades or wings 23. This alignment is illustrated by the fact that the two apertures 25, through which pass the set screw 19 are overlaid. The pair of blades as illustrated are shown in what would be their internal stowed positioning. The edges of a single blade are better understood by reference to FIG. 11. Thus each blade features an arcuate segment 33 adjacent to which is a mounting bore 25 through which passes the set screw 19. A notched out area 34 adjacent the arcuate segment 33, serves to narrow the width of the blade at the mounting end thereof. The planar blade includes a pair of spaced parallel edges 27, 29 of substantially equal length. The non-parallel or main edge 32 is disposed at about a 45 degree angle to the two parallel edges, to somewhat resemble an X-acto® knife blade. While shown in the drawing point down, the blade is actually mounted with the point 36 disposed upwardly and outwardly when in the in-use position.

Figure 12:
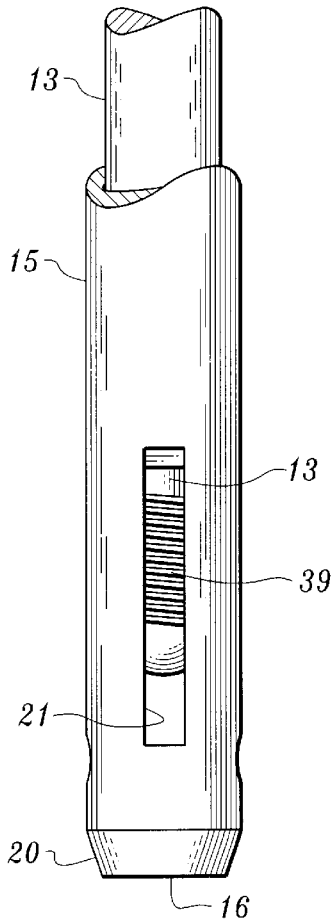
FIG. 12 is a side elevational view with the operative shaft rotated downwardly to the blade location.

FIG. 12 is a close-up view of the lower distal end of the tube 15. The two blades 23 have been removed from the slots 21A, 21B and at this particular angle, the threading 39 of shaft 15 is visible.

Figure 13:
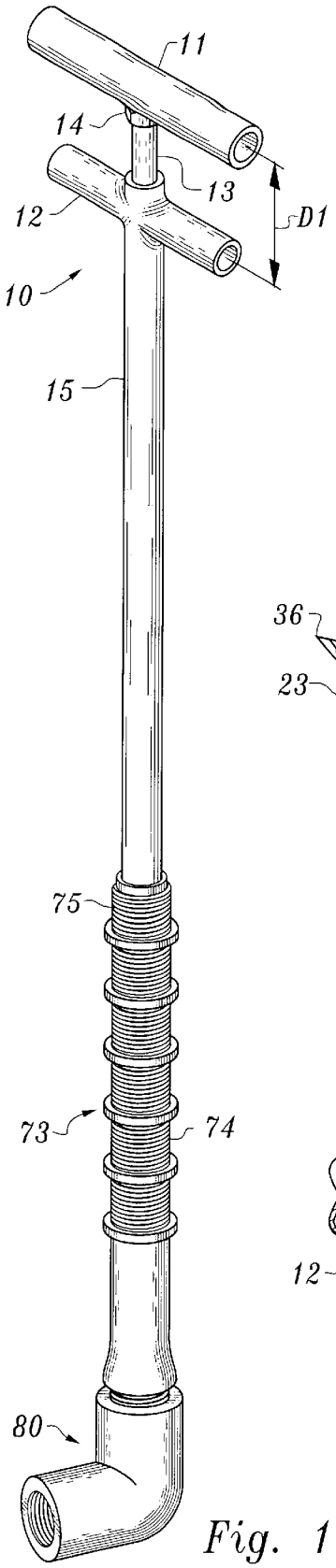
FIG. 13 is a perspective view illustrating the use of the device wherein the operative shaft is extended outwardly prior to utilization, i.e., a rotational movement.

The next view, FIG. 13, shows device 10 disposed within a riser 74 for insertion of the riser into elbow 80. Note the position of the handle 11 mounted on the threaded shaft 13, relative to the fixed location of tee handle 12. The insertion process has not yet started. The finite distance known as D' is delineated in FIG. 13.

Figure 14:
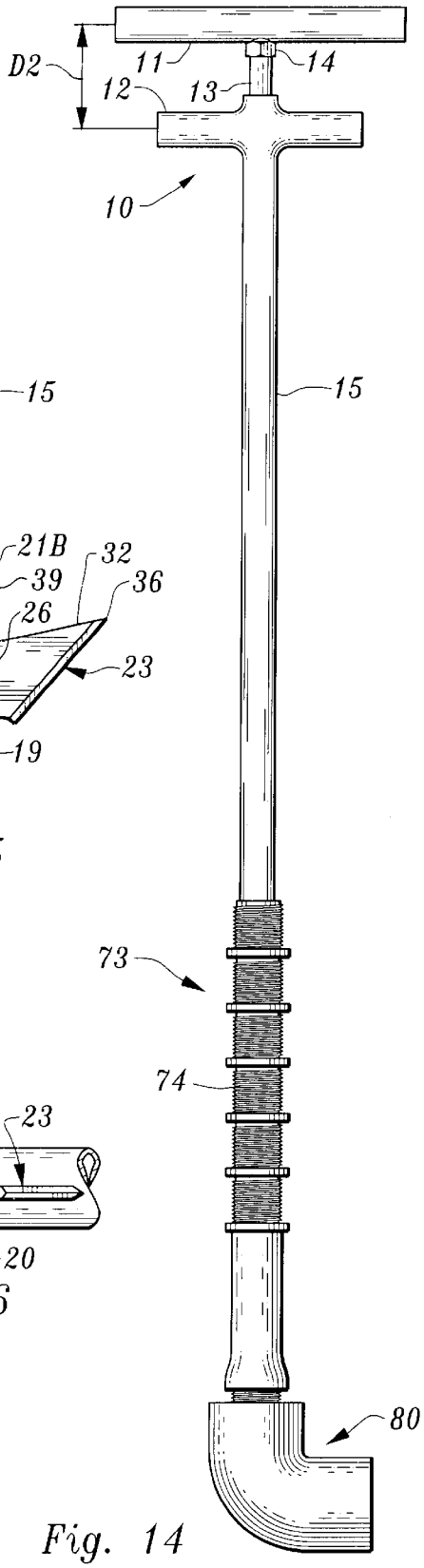
FIG. 14 is a plan view wherein the operative shaft has been moved into its operative position within a riser.

As one threads the shaft 15 downwardly by rotation of handle 11, the finite distance between the handle 11, and tee handle 12 is diminished as the wings (unseen) emerge having been urged outwardly by the tip of the threaded shaft 15. This second distance is D2 and D2 is less than D1. At the moment in time of FIG. 14, the downward threading of shaft 15 is not quite complete.

Figure 15:
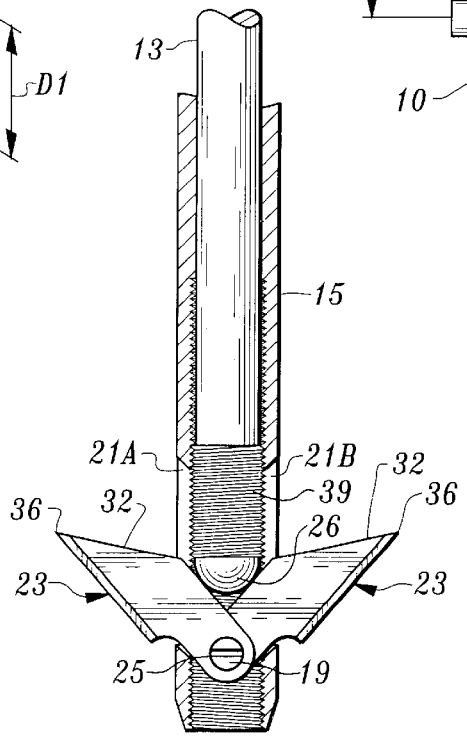
FIG. 15 is a cutaway view to illustrate the motion that transpires as the threaded shaft urges the blades outwardly.
Figure 16:
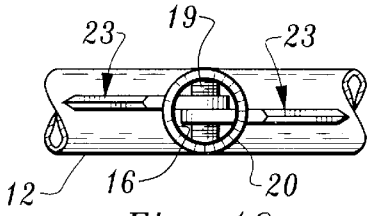
FIG. 16 is a bottom plan view of this apparatus.

Reference to FIGS. 15 and 16 permits the reader to better understand the motion involved in this apparatus. The juxtaposed mirror image positioning of the two blades 23 is seen in the bottom plan view FIG. 16, wherein the blades have been extended as if they were disposed within a riser. Description 16 is the actual open bottom of the tube whereas 20 is the tapered end of the tube.

As the threaded shaft shown in FIG. 15 is threaded down into tube 23, the tip 26 of the shaft impacts surface 32 of each blade 23. Since the positioning of surface 32 is angularly disposed, the pressure upon surface 32 causes each blade to rotate outwardly around the set screw 19. Notch 34 gives the clearance needed for each blade 23 to move outwardly without binding on the edge of its respective slot 21.

Since the shaft is threaded into position, the wings retain an outward bound position until such time as the shaft is withdrawn upwardly. Note also how in FIG. 15 the points 36 bite into the interior side wall of the riser for insertion as is desired.

It is seen that I have provided a relatively easy to use tool for removing and reinserting risers into sprinkler piping connectors. The tool can be made of steel, aluminum or plastic.

Since certain changes may be made in the above device without departing from the scope of the invention herein involved, it is intended that all matter contained in the above description, shall be interpreted as illustrative and not in a limiting sense.

I claim:

1. An apparatus for installing a sprinkler riser into a sprinkler system connector which apparatus comprises:

an elongated tube having internal threads, said tube being open at the distal end and open at the proximal end;

a retainer mounted normal to said tube at the proximal end of said tube;

a threaded shaft threadingly engaged with the internal threads of said tube disposed in said tube and extending upwardly out of said tube, said shaft having a terminus;

said tube having a pair of similarly sized slots disposed slightly spaced up from the distal end of said tube, 180 degrees apart;

said tube further including a threaded bore disposed between said slots and the distal end of said tube, normal to said slots;

a pair of overlaid mirror image wings, disposed one per slot within said tube, each of said wings having an aperture at one end aligned with the aperture of the other wing;

a set screw disposed through said bore and passing through said apertures to pivotally mount said wings for movement from a stowed position within said tube to an extended position outside of said tube by movement through a respective slot;

a handle mounted to said shaft to rotate said threaded shaft within said tube whereby when said threaded shaft is threadedly engaged, said shaft terminus will urge the pivotally mounted blades from their stowed first position, to the extended second position and then retain the blades in said extended position such that the blades when extended bite into the internal wall of sprinkler riser such that rotation of the apparatus causes the riser to rotate in turn for engagement with the sprinkler system connector.

2. The apparatus of claim 1 wherein the distal end of the internally threaded tube is inwardly tapered slightly.

3. An apparatus for installing a sprinkler riser into a sprinkler system connector which apparatus comprises:

a internally threaded tube, having a threaded bore adjacent a first end, and having a pair of mirror image slots disposed slightly upwardly from said bore, each slot being normal to said bore;

a pair of aperture wings disposed in said slots and within said tube, being pivotally mounted by a set screw threadedly engaged in said bore, each wing being capable of independent movement from a stowed position within said tube to an extended position sticking out through said slot and extending outwardly of said tube;

a male threaded shaft disposed in said tube and extending outwardly from said shaft at the second end of said tube said shaft having a terminus;

whereby when said shaft is threadedly engaged by rotating said shaft into said tube, said shaft's termini will impact said wings causing said wings, if in the stowed position to move to the extended position, and remain there, and if the wings are already extended, to remain in the extended position, said wings not be able to return to the interior position until said threaded shaft is unthreaded in part to a position where the termini of the shaft is above the slots.

4. The apparatus of claim 3 further including a handle disposed on said threaded shaft for rotating said shaft.

5. The apparatus of claim 4 wherein the end of the threaded tube adjacent the bore is slightly tapered.

6. The apparatus of claim 3 further including a retainer mounted to said tube transverse to the tube at the second end thereof.

7. A process for installing a riser into a female threaded sprinkler system connector which process comprises:

(a) disposing an apparatus comprising a tubular member having an internally threaded shaft therein, said shaft having a terminus, said tubular member having a pair of opposed slots, from each of which slots can emerge an outwardly extendable wing upon urging of the shaft's terminus, into a sprinkler riser, which riser has an interior wall and a threaded male threadable end, (b) causing the wings to extend outwardly to contact the interior wall of said riser, by rotating the threaded shaft, (c) continuing the rotation of the shaft such that the extended wings will bite into the side wall of the riser, (d) rotating the apparatus within the riser to threadedly engage the male threads of the riser into the female threads of the sprinkler connector.

8. The process of claim 7 further including the steps of unthreading the shaft of the apparatus by counter rotating the shaft to release the wings from their bite into the side wall of the riser, and withdrawing the apparatus.

* * * * *